US011413494B1

(12) United States Patent
Habing

(10) Patent No.: US 11,413,494 B1
(45) Date of Patent: Aug. 16, 2022

(54) PUSH PULL ROWER

(71) Applicant: Dream Visions, LLC, Tustin, CA (US)

(72) Inventor: Theodore G. Habing, Tustin, CA (US)

(73) Assignee: HABLAMER, LLC, Green Cove Springs, FL (US)

( * ) Notice: Subject to any disclaimer, the term of this patent is extended or adjusted under 35 U.S.C. 154(b) by 0 days.

(21) Appl. No.: 15/873,835

(22) Filed: Jan. 17, 2018

Related U.S. Application Data

(60) Provisional application No. 62/447,843, filed on Jan. 18, 2017.

(51) Int. Cl.
*A63B 21/22* (2006.01)
*A63B 23/12* (2006.01)
(Continued)

(52) U.S. Cl.
CPC ..... *A63B 22/0087* (2013.01); *A63B 21/227* (2013.01); *A63B 21/4035* (2015.10);
(Continued)

(58) Field of Classification Search
CPC ..... A63B 21/159; A63B 21/0615; A63B 21/4033; A63B 21/4035; A63B 21/4045; A63B 21/4047; A63B 21/227; A63B 22/0002; A63B 22/0046; A63B 22/0087; A63B 23/0227; A63B 23/1209; A63B 2225/09; A63B 2069/064; A63B 2069/066; A63B 21/225; A63B 22/0076; A63B 22/06; A63B 22/0605; A63B 22/0611; A63B 22/0623; A63B 22/0629;
(Continued)

(56) References Cited

U.S. PATENT DOCUMENTS 4,743,010 A * 5/1988 Geraci ..... A63B 22/0076 482/72
5,072,929 A * 12/1991 Peterson ..... A63B 22/0076 482/72

(Continued)

FOREIGN PATENT DOCUMENTS

CN 202654614 U 1/2013
CN 204233672 U 4/2015

OTHER PUBLICATIONS

"*Caraleen Enterprises Pty., LLC* v. *Health In Motion LLC*; Case No. 5:20-cv-00821; Complaint for Patent Infringement: Demand for Jury Trial" Filed Apr. 17, 2020 in the United States District Court Central District of California.

*Primary Examiner* — Nyca T Nguyen
*Assistant Examiner* — Zachary T Moore
(74) *Attorney, Agent, or Firm* — Womble Bond Dickinson (US) LLP

(57) ABSTRACT

A rowing machine provides resistance to both pushing and pulling motions of both the upper body and lower body. A linear sliding seat that moves in a longitudinal direction is connected to a flywheel to provide resistance to back and forth motion. A handle arm is also connected to the flywheel to provide resistance to back and forth motion. The flywheel creates cyclical back and forth motion of the seat and handles for the user to push and pull with the arms and legs. The handle arm and seat may be linked together, and then one or the other linked to the flywheel, providing synchronization between the handlebar, carriage and flywheel.

21 Claims, 1 Drawing Sheet

(51) Int. Cl.
*A63B 22/00* (2006.01)
*A63B 21/00* (2006.01)

(52) U.S. Cl.
CPC ..... *A63B 21/4045* (2015.10); *A63B 21/4047* (2015.10); *A63B 22/0002* (2013.01); *A63B 22/0046* (2013.01); *A63B 23/1209* (2013.01); *A63B 2225/09* (2013.01)

(58) Field of Classification Search
CPC ..... A63B 22/0664; A63B 22/0635; A63B 22/0652; A63B 21/15; A63B 21/153; A63B 21/154; A63B 21/157; A63B 21/22; A63B 21/222; A63B 22/20–208; A63B 23/02–0244; A63B 23/035
USPC ..... 482/51–52, 72–73, 95–96
See application file for complete search history.

(56) References Cited

U.S. PATENT DOCUMENTS 5,374,225 A * 12/1994 Wilkinson ..... A63B 5/11 482/114
5,382,209 A 1/1995 Pasier et al.
5,419,752 A * 5/1995 James ..... A61H 1/02 482/51
5,916,065 A * 6/1999 McBride ..... A63B 22/0664 482/57
5,928,116 A * 7/1999 Chiang ..... A63B 23/03525 482/72
6,042,512 A 3/2000 Eschenbach
6,482,133 B1 * 11/2002 Miehlich ..... A63B 21/068 482/57
7,104,933 B1 * 9/2006 Liao ..... A63B 21/012 482/114
7,141,008 B2 11/2006 Krull et al.
7,651,446 B1 * 1/2010 Eschenbach ..... A63B 23/0216 482/52
7,815,551 B2 10/2010 Merli
7,862,484 B1 * 1/2011 Coffey ..... A63B 21/157 482/72
8,113,997 B2 * 2/2012 Fernandez ..... A63B 22/0087 482/71
8,491,506 B2 7/2013 Smyrk et al.
8,562,491 B2 10/2013 Merli
8,888,661 B2 * 11/2014 Ellis ..... A63B 21/0615 482/72
9,005,086 B1 * 4/2015 O'Neil ..... A63B 22/0076 482/51
9,289,647 B2 3/2016 Merli
9,457,223 B2 * 10/2016 Eschenbach ..... A63B 22/0664
10,086,227 B2 10/2018 Merli
2003/0060337 A1 * 3/2003 Yu ..... A63B 69/0093 482/57
2005/0187073 A1 * 8/2005 Krull ..... A63B 69/06 482/72
2006/0223678 A1 * 10/2006 MacLean ..... A63B 22/001 482/51
2012/0100965 A1 * 4/2012 Dreissigacker ..... A63B 21/157 482/72
2015/0151158 A1 * 6/2015 Ellis ..... A63B 21/159 482/142
2015/0367173 A1 * 12/2015 Ellis ..... A63B 21/00181 482/127
2016/0287933 A1 * 10/2016 Lin ..... A63B 22/0056

* cited by examiner

PUSH PULL ROWER

CROSS-REFERENCE TO RELATED APPLICATION

This application claims the benefit of the earlier filing date of U.S. Provisional Patent Application No. 62/447,843, filed Jan. 18, 2017 and incorporated herein by reference.

BACKGROUND OF THE INVENTION

Field of the Invention

The present invention relates generally to the field of exercise machines. More particularly, the invention relates to an apparatus for performing a two directional resistance rowing exercise.

Background

U.S. Pat. No. 7,141,008 discloses a rowing machine in which a 3-bar link frame is attached to a flywheel via an upper link. This causes the 3-bar link to move with the flywheel. The central portion upper link moves in an elliptical motion. A seat is attached to the upper link and moves with it. This layout causes the seat to move in an elliptical path where the user's body goes up and down and forward and back following the elliptical seat movement. The row handles are linked to movement of the frame. This rower provides resistance to pushing and pulling movement of the arms and upper body and the legs, against resistance of the flywheel.

A disadvantage of this design is that the rotation momentum of the flywheel is increased with the user body weight when the frame link to the flywheel is going down on one side of the flywheel and decreased when the frame link to the flywheel is going up on the other side. The momentum must be strong enough to carry the user on the up side of the flywheel movement or the pushing or pulling exercise is much harder on the upward movement of the flywheel. Thus, it is harder to keep the rotation momentum of the flywheel going and also harder to keep it going steady. It requires a heavier flywheel and a faster moving flywheel with stepped up speed.

Another disadvantage of this design is that the weight of the upper link causes the upper link to settle at the bottom of flywheel rotation and thus places the handles in a position that is hard to enter and exit the machine when stopping or starting an exercise.

Still another disadvantage of this design is that the ellipse feels better in one direction than the other—there is a forward and backward motion. It is difficult for the user to know which direction they are moving.

Still another disadvantage of this design is that some people tend to get motion sickness from the up and down motion mixed with the forward and back motion. This motion has a tendency towards motion sickness for some people.

U.S. Pat. No. 5,072,929 discloses a rower with two resistance flywheels. One flywheel is attached to a handle by a cord to provide resistance to the handle. The other flywheel is attached to the seat by a cord to provide resistance to the seat. In this design the handle has resistance to pulling with the arms and upper body, but not pushing with the arms and upper body. The seat has resistance to pushing movement of the legs, but not pulling movement of the legs. A disadvantage of this design is that it requires two separate flywheels and does not provide resistance in both directions of movement, thus only working out part of the body of a user.

SUMMARY OF THE INVENTION

Disclosed is a rowing machine with resistance to both pushing and pulling motions of both the upper body and lower body. A linear sliding seat that moves in a longitudinal direction is connected to a flywheel to provide resistance to back and forth motion. A handle arm is also connected to the flywheel to provide resistance to back and forth motion. The flywheel creates cyclical back and forth motion of the seat and handles for the user to push and pull with the arms and legs. The handle arm and seat (or carriage) may be linked together, and then one or the other linked to the flywheel, providing synchronization between the handlebar, seat (or carriage) and flywheel. For example, in one embodiment, the handle arm and the seat are linked together by a first link, and the handle arm is linked to the flywheel by a second link. Alternatively, the handle arm and the seat are linked together by the first link, and the seat is linked to the flywheel by a second link.

One of the advantages of this invention over the prior art is that a smaller flywheel and slower flywheel spin can be used because there is no up and down movement with the body causing the flywheel to slow down or speed up through phases of each rotation.

Another advantage is that this rower does not have the user's body weight pushing down on the flywheel, so at the end of exercising the user can stop anywhere along the travel making it easy to exit and enter next time.

Still another advantage is that the rotation direction of the flywheel does not affect the motion or the feel of the exercise. The flywheel can turn either direction to give the same linear effect and feel. The user does not have to try to figure out which direction the flywheel is moving, making it much easier to hop on and start.

Yet another advantage is that this rower does not cause motion sickness because the user experiences a basic back and forth movement.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

The terminology used herein is for the purpose of describing particular embodiments only and is not intended to be limiting of the invention. Spatially relative terms, such as "beneath", "below", "lower", "above", "upper", "forward", "rearward", "backward" and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
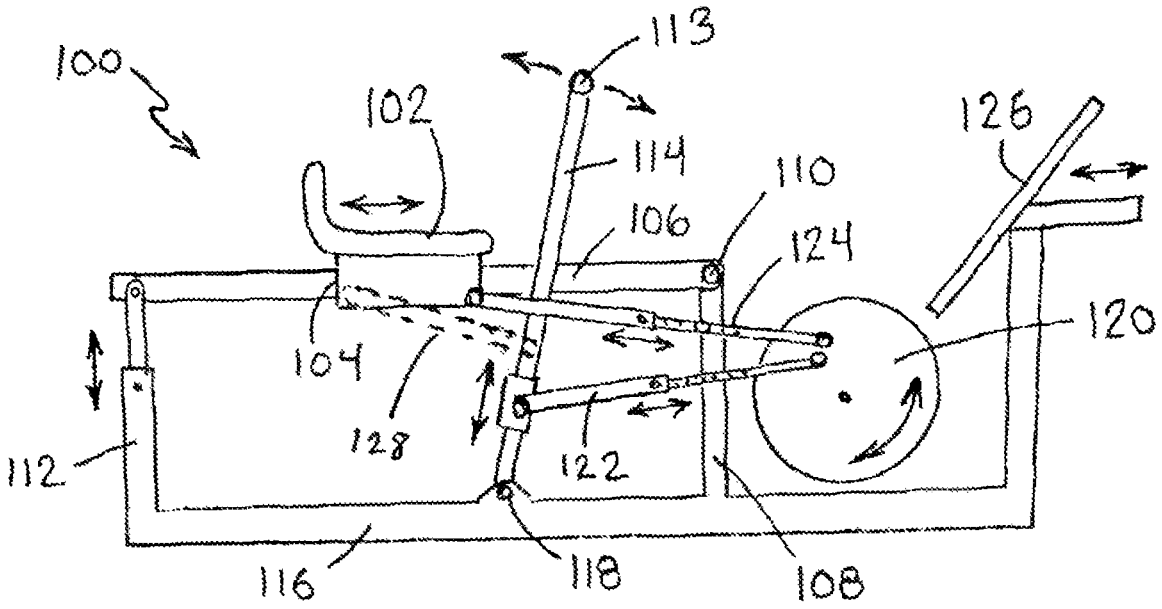
FIG. 1 is a diagrammatic illustration of an exercise apparatus in accordance with a first embodiment of the invention.

FIG. 1 illustrates an exercise apparatus 100 in accordance with a first embodiment of the invention. A seat 102 for the operator of the apparatus is attached to a carriage 104 that slides along support member 106. The forward end of support member 106 is connected to upright member 108 at pivot 110. The rearward end of support member 106 is coupled to upright member 112, which is adjustable to raise and lower the rearward end of support member 106 and thereby adjust the angle of inclination for the path of travel of seat 102. Similarly, upright members 108 and 112 can be switched so that the front is adjustable to provide the incline and simultaneously adjust the starting bend position of the users legs when the users feet are on the footplate 126, allowing an easier or harder start. Although apparatus 100 is illustrated with a straight support member 106 along which carriage 104 and seat 102 slide in a linear path, support member 106 could be longitudinally curved, in which case carriage 104 and seat 102 would slide in an arcuate path.

A row handle comprises a laterally extending handlebar 113 attached to lever 114, which is coupled to frame member 116 at pivot 118. Lever 114 is coupled to flywheel 120 by link 122. The length of link 122 is adjustable (as shown by the arrow) and the position at which link 122 is pivotally coupled to lever 114 are both adjustable to define the operative arc of handlebar 113 relative to rotation of flywheel 120. Moving the coupling position of link 122 up or down along the length dimension of lever 114 (as shown by the arrow) shortens or lengthens, respectively, the arc of handlebar 113. Shortening or lengthening link 122 adjusts the longitudinal position of the arc of handlebar 113, i.e., the start and end positions of the exercise stroke, relative to the apparatus without changing the arc length. Said another way, the length of link 122 or position of link 122 along the length of lever 114 can be adjusted (as shown by the arrows) to modify a range of movement and/or position of the handlebar 113 (or lever 114), which in turn can achieve a shorter or longer stroke, or move the stroke forward or rearward, as desired.

Flywheel 120 is also coupled to carriage 104 by link 124. It should be noted that for ease of illustration, link 122 and link 124 are shown along a same side of flywheel 120, however, in reality, they would be coupled to opposite sides of flywheel 120. The length of link 124 is adjustable (as shown by the arrow) to define the travel path of seat 102 along support member 106 relative to rotation of flywheel 120. The adjustments of links 122 and 124 accommodate the physical proportions of the operator and also, in combination with adjustment of upright member 112, allow the operator to adjust the intensity and muscular focus of the exercise.

In alternative arrangements, the handlebar and carriage can be directly linked together by an optional link 128 and then one or the other linked to the flywheel, providing synchronization between the handlebar, carriage and flywheel. For example, in one alternative embodiment, carriage 104 may be directly coupled to lever 114 of the handlebar 113 by link 128 (shown in dashed lines). Then, lever 114 may be coupled to the flywheel 120 by link 122 (and link 124 omitted), or carriage 104 may be coupled to the flywheel 120 by link 124 (and link 122 omitted).

A foot plate 126 is mounted at the forward end of apparatus 100 and is longitudinally adjustable to accommodate the length of the operator's legs. The outstretched end of motion for the user's legs should be almost straight but with a slight bend at the knee (not fully extended). The proper leg posture may also be achieved by adjusting the length of link 124 which, in turn, adjusts the distance between seat 102 and foot plate 126. Furthermore, the longitudinal position of seat 102 on carriage 104 may be made adjustable for the same purpose.

Figure 2:
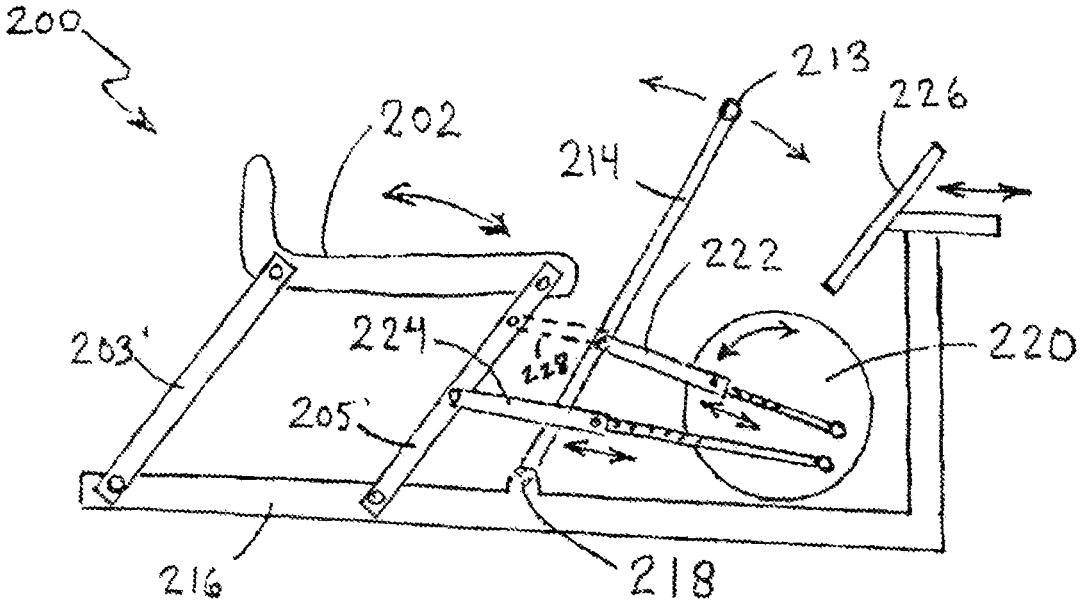
FIG. 2 is a diagrammatic illustration of an exercise apparatus in accordance with a second embodiment of the invention.

FIG. 2 illustrates an exercise apparatus 200 in accordance with a second embodiment of the invention. This apparatus is generally similar to apparatus 100 described above; however, rather than sliding on a carriage, seat 202 is supported by linkage arms 203 and 205. Seat 202 therefore moves in an arcuate path defined by the geometry of the pivot points linking arms 203 and 205 to seat 202 and frame member 216, which may be made adjustable by well known means.

A laterally extending handlebar 213 is attached to lever 214, which is coupled to frame member 216 at pivot 218. Lever 214 is coupled to flywheel 220 by link 222. Flywheel 220 is also coupled to linkage arm 205 by link 224. As in the previously described embodiment, links 222 and 224 are adjustable along their length dimension (and in some cases along a length of the associated arm 205 or lever 214) as shown by the arrows to accommodate the physical proportions of the operator and also allow the operator to adjust the intensity and muscular focus of the exercise. In addition, although for ease of illustration, link 222 and link 224 are shown along a same side of flywheel 220, in reality, they would be coupled to opposite sides of flywheel 220.

Still further, in one alternative embodiment, the handlebar 213 and seat 202 may be directly linked together by an optional link 228 and then one or the other linked to the flywheel 220, providing synchronization between the handlebar, seat and flywheel. For example, in one alternative embodiment, seat 202 may be directly coupled to lever 214 of the handlebar 213 by link 228 (shown in dashed lines). Then, lever 214 may be coupled to the flywheel 220 by link 222 (and link 224 omitted), or seat 202 may be coupled to the flywheel 220 by link 224 (and link 222 omitted).

A foot plate 226 is mounted at the forward end of apparatus 200 and is longitudinally adjustable to accommodate the length of the operator's legs.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

The invention claimed is:

1. An exercise apparatus comprising:

a frame;

a flywheel coupled to the frame for rotation;

a carriage coupled to a support member for sliding movement thereon;

a seat attached to the carriage;

a row handle lever pivotally coupled to the frame; and a linkage system coupling the row handle lever and the carriage to the flywheel, wherein the linkage system comprises a first link that directly connects the row handle lever to the flywheel and a second link that directly connects the carriage to the flywheel, and wherein the seat travels along a linear path and the linkage system couples the carriage to the flywheel to provide a reciprocating movement along the linear path.

2. The exercise apparatus of claim 1, wherein at least one of the first and second links is a telescopic link that is configured to extend or shorten along a longitudinal axis of the telescopic link.

3. A straight linear seat path rower comprising a flywheel to provide resistance to a user's pushing and pulling movement of both a row handle lever and a seat associated with the rower, wherein the pushing and pulling movement of both the row handle lever and the seat are synchronized via links to the flywheel, the links comprising at least one link that directly connects the row handle lever to the flywheel, and the flywheel is positioned proximate a foot plate coupled to the rower.

4. The rower of claim 3 wherein the at least one link that directly connects the row handle lever to the flywheel associated with the rower is a telescopic link.

5. The rower of claim 3 further comprises a handlebar that is attached to the row handle lever and with which the pushing and pulling movement is exerted upon by the user of the rower.

6. The rower of claim 3 wherein the row handle lever is pivotably connected to the flywheel associated with the rower.

7. The rower of claim 6 wherein the row handle lever comprises a number of handle start positions that are adjustable with a telescopic link connected to the flywheel.

8. The rower of claim 7 wherein a range of a handle stroke is made shorter or longer with adjustable positioning of the telescopic link along a length dimension of the row handle lever.

9. The linear seat path rower of claim 3, wherein the at least one link is a first link, and the links comprise a second link that connects the seat to the flywheel or the row handle lever associated with the rower, and the seat comprises a number of seat start positions that are adjustable with the second link.

10. The linear seat path rower of claim 9, wherein the second link connects the seat to the row handle lever associated with the rower.

11. The linear seat path rower of claim 3 wherein the links comprise a telescopic link that connects the seat to the flywheel associated with the rower.

12. The linear seat path rower of claim 3 wherein the foot plate is attached to a front end of the frame.

13. A rower comprising:

a frame with forward, middle and rearward sections;

a flywheel rotatably coupled to the forward section of the frame;

a seat slidably coupled to the frame; and a row handle lever having a length dimension defined by a first end and a second end, the second end is pivotally coupled directly to the middle section of the frame, below the seat, wherein the seat, the row handle lever, and the flywheel are linked together by a linkage system comprising at least one link that directly connects the row handle lever to the flywheel and operable to provide a reciprocating movement of each of the seat and the row handle lever in a respective same path forward and rearward during a full revolution of the flywheel while exercising.

14. The rower of claim 13 wherein the row handle lever is pivotally linked to the movement of the seat, and wherein a range of movement of the row handle lever is adjustable.

15. The rower of claim 13 wherein the range of movement of the row handle lever is adjustable for a shorter stroke or a longer stroke.

16. The rower of claim 15 wherein the row handle lever has adjustable positions, and the adjustable positions move the stroke forward or rearward.

17. The rower of claim 13 wherein the linkage system links the seat, the row handle lever and the flywheel, and a foot plate, and wherein the linkage system comprises an extension link, and wherein the distance from the seat to the foot plate is adjustable by the extension link.

18. The rower of claim 13 further comprising a resistance to pushing and pulling movement of the handle and the seat.

19. The rower of claim 13 wherein the seat travels along a linear path and the linkage system couples the seat to the flywheel to provide a reciprocating movement along the linear path.

20. The rower of claim 13 wherein the flywheel is a forward and reverse spin flywheel that drives the reciprocating movement of the seat along the same path forward and rearward regardless of whether the spin flywheel is moving forward or reverse.

21. An exercise apparatus comprising:

a frame having a front end;

a flywheel coupled to the front end of the frame;

a foot plate attached to the front end of the frame;

a seat movably coupled to the frame;

a row handle lever movably coupled to the frame, wherein the seat and the row handle lever are both connected with the flywheel and move back and forth in a synchronized movement, and wherein an elevation relationship between the seat and the row handle lever at every point while moving back and forth are the same.

* * * * *